US008616293B2

(12) United States Patent
Robertson et al.

(10) Patent No.: US 8,616,293 B2
(45) Date of Patent: Dec. 31, 2013

(54) TOOL POSITIONING AND LATCHING SYSTEM

(76) Inventors: Michael C. Robertson, Arlington, TX (US); William F. Boelte, New Iberia, LA (US); Douglas J. Streibich, Fort Worth, TX (US)

( * ) Notice: Subject to any disclaimer, the term of this patent is extended or adjusted under 35 U.S.C. 154(b) by 348 days.

(21) Appl. No.: 12/625,179

(22) Filed: Nov. 24, 2009

(65) Prior Publication Data

US 2011/0120731 A1 May 26, 2011

(51) Int. Cl.
*E21B 23/00* (2006.01)

(52) U.S. Cl.
USPC ..... 166/382; 166/55

(58) Field of Classification Search
USPC ..... 166/55, 297, 298, 301, 382
See application file for complete search history.

(56) References Cited

U.S. PATENT DOCUMENTS

| | | | | | |
|---|---|---|---|---|---|
| 1,614,840 | A | * | 1/1927 | Jones | 166/55.6 |
| 1,677,507 | A | * | 7/1928 | Vock et al. | 166/55.7 |
| 2,204,091 | A | | 6/1940 | Lowrey | |
| 2,380,022 | A | * | 7/1945 | Burt | 166/214 |
| 2,692,648 | A | * | 10/1954 | Simmons | 166/214 |
| 2,741,316 | A | * | 4/1956 | Long | 166/63 |
| 2,862,564 | A | | 12/1958 | Bostock | |
| 3,175,617 | A | * | 3/1965 | North | 175/4.51 |
| 3,344,862 | A | | 10/1967 | Conrad | |
| 4,108,243 | A | * | 8/1978 | King et al. | 166/66.7 |
| 4,369,840 | A | | 1/1983 | Szarka et al. | |
| 4,466,497 | A | * | 8/1984 | Soinski et al. | 175/246 |
| 4,510,995 | A | | 4/1985 | Krause, Jr. et al. | |
| 4,570,707 | A | | 2/1986 | Setterberg, Jr. | |
| 5,720,344 | A | * | 2/1998 | Newman | 166/253.1 |
| 6,012,527 | A | | 1/2000 | Nitis et al. | |
| 6,199,632 | B1 | | 3/2001 | Shy | |
| 6,631,768 | B2 | * | 10/2003 | Patel et al. | 166/373 |
| 6,761,217 | B1 | | 7/2004 | McGarian | |
| 6,929,063 | B2 | | 8/2005 | Reese et al. | |
| 7,506,700 | B1 | * | 3/2009 | Harvey et al. | 175/61 |
| 7,640,975 | B2 | * | 1/2010 | Cavender et al. | 166/207 |
| 7,726,392 | B1 | * | 6/2010 | Robertson | 166/55 |
| 7,814,978 | B2 | * | 10/2010 | Steele et al. | 166/297 |
| 2003/0173089 | A1 | | 9/2003 | Westgard et al. | |
| 2004/0104031 | A1 | * | 6/2004 | Smith | 166/382 |

OTHER PUBLICATIONS

International Search Report for Patent Application No. PCT/US2010/002888, dated Jan. 7, 2011 (25 pages).

* cited by examiner

*Primary Examiner* — Daniel P Stephenson
*Assistant Examiner* — Kipp Wallace

(57) ABSTRACT

A system and method for positioning a tool within a wellbore are described herein. The interior surface of a tubular string is provided with one or more pluralities of grooves, each defining a selected profile. A tool is lowered into the tubular string, having a blade in communication therewith. The blade includes a plurality of protruding members thereon, which define a profile complementary to at least one of the selected profiles formed by one of the pluralities of grooves. A biasing member in communication with the blade continually biases the blade toward the interior surface of the tubular string to cause the profile of the blade to engage within the corresponding complementary profile of the tubular string. Positioning a tool in this manner is especially advantageous for locating a cutting tool at a precise location to sever a tubular segment at a joint, releasing tensile forces from the joint.

26 Claims, 4 Drawing Sheets

TOOL POSITIONING AND LATCHING SYSTEM

FIELD

The present invention relates, generally, to systems and methods usable to position a tool within a tubular string at a selected location, enabling precise actuation of the tool on or within a desired region of a tubular string.

BACKGROUND

During well construction and other downhole operations, it is common for drill bits and other tools to become stuck. When this occurs, there are a very limited number of techniques usable to wholly or partially free or remove this expensive equipment, many of which involve cutting or otherwise perforating a tubular string to remove at least a portion of the string and any attached tools from the wellbore.

Typically, drilling equipment requires use of heavy-walled tubular members, having small inner diameters, which limits the amount of working space within a tubular string. Therefore, when cutting or otherwise attempting to remove these heavy-walled tubular components, the effectiveness of cutting and removal tools is limited due to the small size of such components necessary for insertion into the tubular string.

Tubular strings include numerous joints, used to connect lengths of drill pipe, drill collars, bits, steering devices, sensors, and other tools and tubular components. To maximize the effectiveness of a cutting device, it is desirable to position and retain a slitter or similar tool directly over a joint between tubular segments. Joints within a drilling string typically include male and female, pin and box ends, thus when cutting a tubular string at a joint, a somewhat thinner section of tubular can be cut. Additionally, cutting a tubular string at a torqued joint releases the tensile forces holding the tubular segments together. This reduction in tensile force at the joint allows the tubular segments to be more readily pulled apart, enabling retrieval of the upper portion of the tubular string.

When screwed together and properly torqued, joints within a tubular string become relatively seamless, thus difficult to locate using conventional devices. While casing collar locators and similar devices are usable to position a tool within a tubular string, these devices are limited in their accuracy, and are generally accurate only within a number of feet. A joint within a tubular string may be only inches in length, requiring far more precise placement of a tool than what is conventionally available using collar locators and similar devices.

Other positioning systems include providing physical features within the interior of a tubular string that interact with corresponding physical features of a locating tool, however these positioning systems require numerous precisely crafted features to ensure proper function and interaction, including various moving parts to cause selective engagement between corresponding features.

A need exists for systems and methods for positioning a tool within a tubular string that enable precise positioning of tools at a preselected location, including joints within the tubular string to facilitate the effectiveness of cutting tools.

A further need exists for systems and methods for positioning a tool within a tubular string that are simple in construction and function, able to incorporate reusable, machinable, and re-machinable parts able to accommodate a variety of latching and/or engaging orientations.

A need also exists for systems and methods for positioning a tool within a tubular string that are pre-tensioned and directionally biased, able to selectively engage and disengage from selected locations.

The present invention meets these needs.

SUMMARY

The present invention relates, generally, to a system usable to position a tool within a wellbore. A section of the interior of a tubular string, which can include any type of casing string, tubing string, drill string or work string, or other type of conduit formed from multiple connected tubular segments, is provided with a plurality of grooves. The grooves can be disposed in a separate sub or other tubular element, or the grooves can be provided to a standard tubular segment used within a string.

The grooves define a selected profile, intended to lock with a complementary profile disposed in association with a tool to be positioned. The selected profile can be defined by the spacing between the grooves, the depth of the grooves, the interior shape of the grooves, or other similar features usable to differentiate the selected profile from other features or profiles within the tubular string. In an embodiment of the invention, the selected profile can be shaped to permit downward movement of a complementary profile into engagement, while preventing upward movement, such as through use of an upwardly facing no-go shoulder, or a similar element within the selected profile and/or the complementary profile.

In a further embodiment of the invention, one or more tubular segments of the tubular string can be provided with standard sets of grooves, and the grooves can in turn be provided with one or more removable members such as snap rings, having an interior surface with a selected profile disposed thereon. An embodiment of the removable members can be seen as elements 51 and 61 in FIG. 2. Through this embodiment, a desired number of identical subs or other tubular segments can be produced, having grooves disposed therein, while interchangeable, removable members can be used to provide each set of grooves with a selected profile.

When a tool is lowered within the tubular string, a blade is provided in communication with the tool, the blade having a plurality of protruding members extending therefrom. The protruding members define a male profile complementary to the selected profile within the tubular string, such that when the tool is lowered such that the blade contacts the selected profile, the complementary profile will engage and lock within the selected profile, allowing the precise position of the tool in relation to the grooves within the tubular string to be determined.

In an embodiment of the invention, the blade provided to the tool can be reusable, interchangeable, machinable, and/or re-machinable, enabling complementary profiles keyed to specific selected profiles within the tubular string to be selectively provided and/or interchanged when it is desired to position a tool at one or more precise locations within the tubular string.

The blade can be secured to or otherwise placed in communication with the tool in any manner. In various embodiments of the invention, a hinged and/or pivotable arm can be provided in communication with the tool and the blade, enabling the blade to pivotably track along the interior surface of the tubular string as the tool is lowered. In a further embodiment of the invention, an anchor can be secured to the tool, a selected distance from the tool, the anchor having the blade disposed in communication therewith. When the profile on the blade engages a selected profile within the tubular string, the position of both the anchor and tool are then able to be determined.

A biasing member, such as a bow spring or other type of spring, a shear pin, or a similar member, can be provided in communication with the blade, to continuously bias the blade outward from the tool, toward the interior surface of the tubular string. Biasing of the blade causes the blade to track along the interior surface of the tubular string while the tool is lowered, facilitating locking of the complementary profile disposed thereon with the selected profile within the tubular string.

While the present invention is usable to position any tool within a tubular string, in a preferred embodiment of the invention, the tool can include a torch, a cutter, or another type of cutting and/or perforating device intended to at least partially cut into a portion of the tubular string. The selected profile within the tubular string can be disposed proximate to a joint within the string, such that when the complementary profile of the blade is engaged with the selected profile, the tool is oriented to cut or perforate the tubular string at or proximate to the joint. Cutting and/or perforating a tubular at or proximate to a joint can release tensile forces from the torqued joint, facilitating removal of a severed portion of the tubing string from the wellbore.

In use, a tubular string can be provided with any number of selected profiles, which differ from one another. Prior to lowering a tool into the tubular string, the tool can be provided with a profile complementary to any of the selected profiles within the tubular string that corresponds to the location to which it is desirable to lower the tool. After the tool has been actuated, or once it is no longer desirable to retain the tool in engagement with the selected profile, the tool can be removed, such as by shearing a shear pin or other frangible member, enabling upward movement of the tool.

The present invention thereby provides systems and methods able to very accurately position a tool within a tubular string at one or more preselected locations, with greater precision than existing methods. All blades, subs, snap rings, and/or other parts used within various embodiments of the present invention can be reusable, interchangeable, machinable, and re-machinable, enabling a tubular string to be provided with any number of standardized or customized profiles, with complementary profiles to be provided to one or more tools. Further, the present systems and methods can include pre-tensioned, directionally biased members usable to selectively engage and disengage from selected locations within a tubular string.

BRIEF DESCRIPTION OF THE DRAWINGS

In the detailed description of various embodiments of the present invention presented below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Figure 1A:
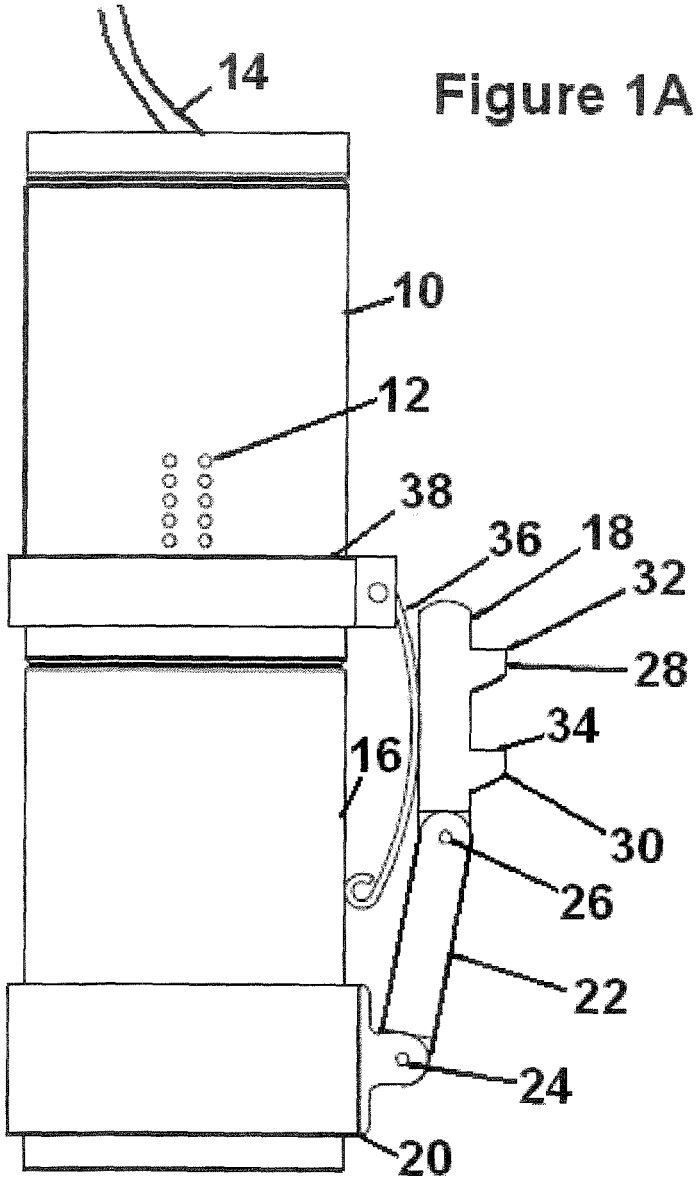
FIG. 1A depicts an embodiment of a male profile disposed in association with a tool.

Referring now to FIG. 1A, an embodiment of a portion of the present system is depicted.

Specifically, FIG. 1A depicts a torch (10), having perforations (12) and/or nozzles disposed therein for providing heat, molten metal, and/or materials for cutting and/or perforating a tubular, the torch (10) being lowered using a conduit (14). While FIG. 1A depicts a torch (10), it should be understood that the present invention is usable to selectively position any type of tool within a wellbore. An exemplary torch usable with various embodiments of the present system is described in U.S. Pat. No. 6,598,679, the entirety of which is incorporated herein by reference.

The torch (10) is shown having an anchor (16) secured thereto, in a direction downhole from the body of the torch (10). A blade (18) is provided in communication with the torch (10) through connection to a collar (20) disposed around the anchor (16). A pivotable arm (22) is shown connected to collar (12) at a first pivot point (24), and to the blade (18) at a second pivot point (26). Movement of the pivotable arm (22) enables the blade (18) to track along the interior surface of a tubular string independent of any interior features, shoulders, protrusions, restrictions, or other changes in diameter within the string.

While FIG. 1A shows the blade (18) secured to the torch (10) using the anchor (16), collar (20), and pivotable arm (22), it should be noted that this configuration is an exemplary embodiment of the invention, and that the blade (18) can be provided in communication with the torch (10) or another tool in any manner that enables the blade (18) to contact the inner surface of the tubular string into which the torch (10) is lowered.

The blade (18) is shown having a first protrusion (28) and a second protrusion (30) disposed thereon, which together define a selected male profile, intended to engage with a complementary female profile within a tubular string, thereby enabling precise positioning of the torch (10). While only two protrusions (28, 30) are shown, the selected male profile can include any number of protruding members having any shape or spacing. The depicted first and second protrusions (28, 30) are shown having first and second no-go shoulders (32, 34), respectively, which prevent upward movement of the blade (18) after engagement of the protrusions (28, 30) within complementary female grooves having matching shoulders.

FIG. 1A further depicts a bow spring (36) attached to the torch (10) using an upper collar (38). The bow spring (36) is disposed in communication with the blade (18) to bias the blade (18) in an outward direction to cause engagement of the protrusions (30, 32) with a complementary profile within the tubular string when the torch (10) and anchor (16) have been lowered to the selected position. While the upper collar (38) is shown disposed around the body of the torch (10), the bow spring (36) or other biasing member can be attached to the anchor (16), or otherwise provided in communication with the blade (18) in a manner to bias the blade (18) in an outward direction.

Additionally, while FIG. 1A depicts the blade (18) and bow spring (36) attached to the torch (10) and anchor (16) through use of collars (20, 38), it should be understood that the depicted embodiment of the invention is an exemplary configuration, and that other attachment and/or mounting members can be used, or various elements can be directly attached to the body of a tool or anchor to be lowered.

Figure 1B:
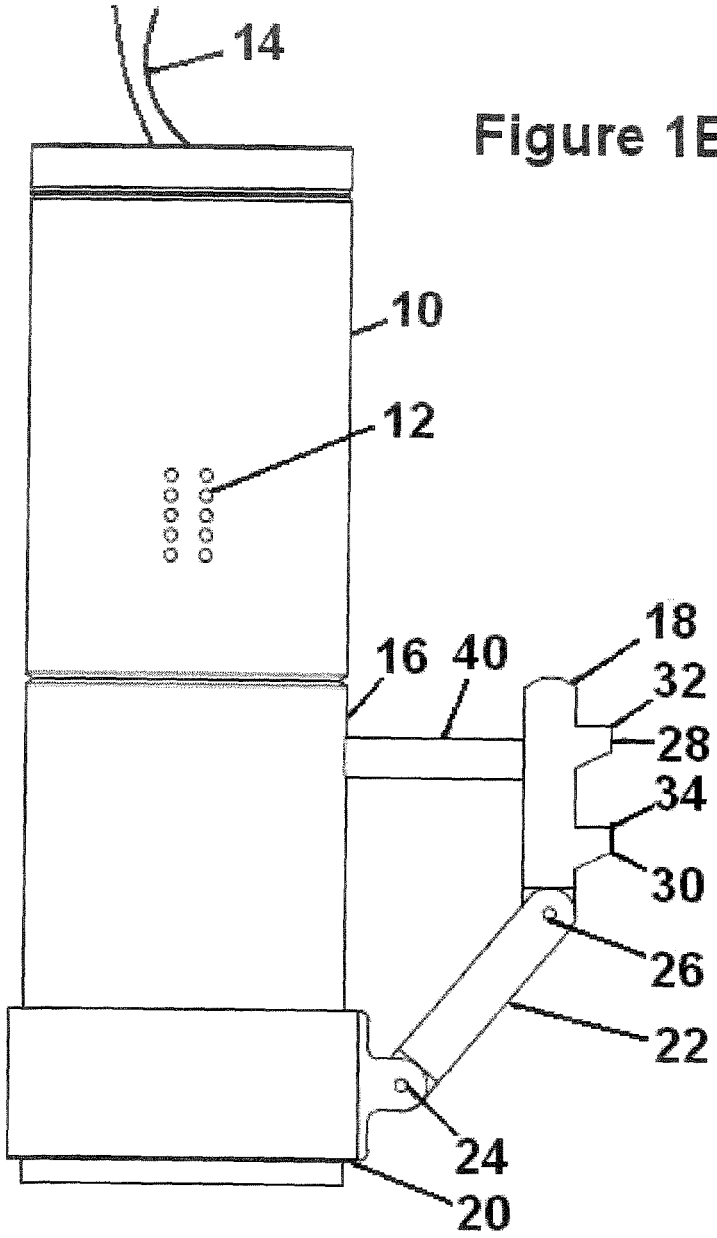
FIG. 1B depicts an alternate embodiment of the male profile and tool of FIG. 1A.

Referring now to FIG. 1B, an alternate embodiment of a portion of the present system is shown, in which a shear pin (40) is used to secure the blade (18) to the anchor (16) and bias the blade (18) in an outward direction. When it is desirable to retrieve the torch (10) and anchor (16), the shear pin (40) can be broken, enabling the blade (18) to be retracted from engagement with a complementary profile.

Figure 2:
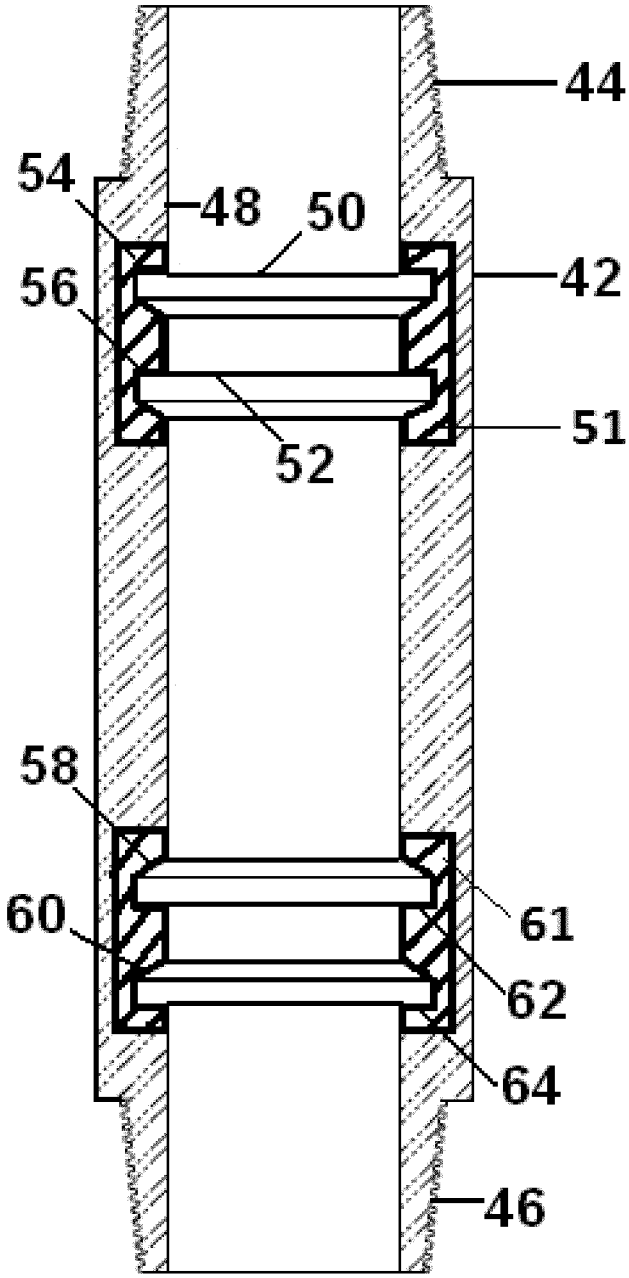
FIG. 2 depicts an embodiment of a female profile disposed within a tubular segment.

Referring now to FIG. 2, an embodiment of a portion of the present system is shown, depicting a tubular segment (42) usable to position a tool having a selected profile disposed thereon. The tubular segment (42) is shown having a first end (44) and a second end (46), which are both depicted as box ends having interior threads. While FIG. 2 depicts two box ends, one or both ends (44, 46) of the tubular segment (42) can include pin ends, depending on the adjacent tubular segments intended for engagement with the depicted tubular segment (42).

The interior surface (48) of the tubular segment (42) is shown having a first groove (50) and a second groove (52) disposed therein, the grooves (50, 52) defining a selected female profile usable to engage with a complementary male profile disposed in association with a tool. The first and second grooves (50, 52) are shown having first and second no-go shoulders (54, 56) within, which prevent upward movement of an engaged tool when a complementary profile having similar shoulders is locked within the grooves (50, 52).

FIG. 2 further depicts a third groove (58) and a fourth groove (60), having no-go shoulders (62, 64) disposed therein. The third and fourth grooves (58, 60) can define a selected female profile different from that defined by the first and second grooves (50, 52), enabling the tubular segment (42) to be installed in an inverted orientation when it is desirable to enable engagement with certain selected male profiles. A complementary male profile configured to engage with a selected female profile will pass over a non-matching and/or inverted female profile.

Figure 3:
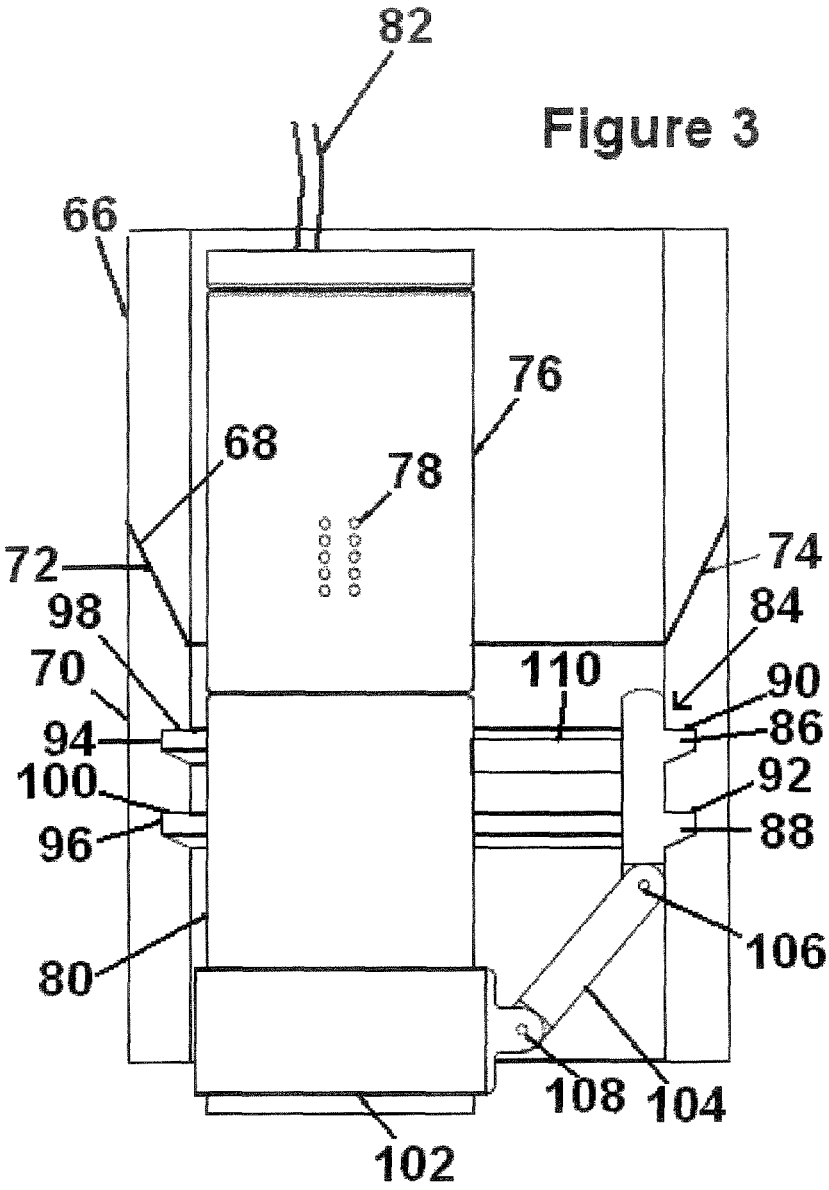
FIG. 3 depicts an embodiment of a tool in engagement with a tubular segment using an embodiment of the present system.

Referring now to FIG. 3, an embodiment of a tool in engagement at a selected location within a tubular string is shown.

Specifically, FIG. 3 depicts a first tubular segment (66) having a pin end (68), engaged with a box end (72) of a second tubular segment (70). Together, when torqued, the box end (72) and pin end (68) define a joint (74), which connects the first and second tubular segments (66, 70) to form a generally seamless portion of a tubular string.

A torch (76) is shown disposed within the tubular string, having perforations and/or nozzles (78) oriented to at least partially cut and/or perforate the outer wall of the tubular string at the joint (74), such that if the size or capabilities of the torch (76) are limited by the inner diameter of the tubular string, only the pin end (68) of the first tubular segment (66) is required to be cut to release the tensile forces from the joint (74) and facilitate removal of the first tubular segment (66) and all components above.

The torch (76) is shown having an anchor (80) secured thereto, the torch (76) and anchor (80) being lowered within the tubular string via a conduit (82). The anchor (80) is shown having a blade (84) in communication therewith, the blade (84) having a first protrusion (86) and a second protrusion (88), together defining a selected male profile. The first and second protrusions (86, 88) are shown having a first no-go shoulder (90) and a second no-go shoulder (92), respectively.

The interior surface of the second tubular segment (70) is shown having a first groove (94) and a second groove (96) disposed therein, which define a selected female profile complementary to the selected male profile of the blade (84). The first and second grooves (94, 96) are provided with first and second interior no-go shoulders (98, 100).

When the torch (76) and anchor (80) are lowered to the selected position within the tubular string, the protrusions (86, 88) of the blade (84) become engaged within the grooves (94, 96) of the second tubular segment (70), with the no-go shoulders (90, 92) of the blade (84), abutting the no-go shoulders (98, 100) of the second tubular segment (70), preventing upward movement of the torch (76) and anchor (80) after engagement.

A collar (102) is shown disposed around the anchor (80), to which the blade (84) is secured, with a pivotable arm (104) disposed therebetween. The pivotable arm (104) provides a range of motion to the blade (84) through a first pivot point (106) disposed between the pivotable arm (104) and the blade (84), and through a second pivot point (108) disposed between the pivotable arm (104) and the collar (102). It should be understood, however, that the blade (84) can be provided in communication with the torch (76) and/or the anchor (80) through any configuration, including or excluding collars and/or arms.

A shear pin (110) is further shown in communication with the anchor (80) and the blade (84), the shear pin (110) biasing the blade (84) in an outward direction such that the blade (84) tracks along the interior surface of the tubular string as the torch (76) and anchor (80) are lowered. When it is desirable to disengage the blade (84) from the second tubular segment (70), the shear pin (110) can be broken, enabling the blade (84) to pivot away from the interior surface of the second tubular segment (70), thereby disengaging the protrusions (86, 88) from the complementary grooves (94, 96).

While various embodiments of the present invention have been described with emphasis, it should be understood that within the scope of the appended claims, the present invention might be practiced other than as specifically described herein.

What is claimed is:

1. A system for positioning a tool within a wellbore, the system comprising:

a first plurality of grooves disposed within an interior of a tubular string disposed within the wellbore, wherein the first plurality of grooves defines a first selected profile, wherein the first selected profile is defined by a first selected spacing of the first plurality of grooves;

a first blade in communication with the tool, wherein the first blade comprises a first plurality of protruding members, and wherein the first plurality of protruding members define a first complementary profile configured to lock only within the first selected profile;

an additional blade interchangeable with the first blade, wherein the additional blade comprises an additional plurality of protruding members, wherein the additional plurality of protruding members define an additional complementary profile configured to lock only within an additional selected profile, wherein an additional selected spacing of said additional complimentary profile is different from the first selected spacing defining the first complimentary profile, and wherein the additional blade bypasses the first selected profile without locking within the first selected profile as the blade moves along an interior surface of a tubular string; and a collar configured for direct attachment to an external surface of the tool;

a hinged arm, wherein the first blade and the collar are connected with the hinged arm, and wherein the first blade and the collar each comprise a single point of connection with the hinged arm; and a biasing member in communication with the first blade, wherein the biasing member continually biases the first blade toward the interior of the tubular string to cause locking of the first complementary profile within the first selected profile, wherein the tool comprises a torch, a cutter, a perforating device, or combinations thereof.

2. The system of claim 1, further comprising a sub disposed within the tubular string, wherein the sub comprises the first plurality of grooves disposed therein.

3. The system of claim 1, further comprising an anchor secured to the tool, wherein the anchor comprises the blade disposed in communication therewith.

4. The system of claim 1, further comprising a removable member disposed on and removable from the interior surface of the tubular string, wherein the removable member comprises the first selected profile of the first plurality of grooves disposed thereon.

5. The system of claim 1, further comprising at least one additional plurality of grooves disposed within the interior of the tubular string, wherein said at least one additional plurality of grooves defines at least one additional selected profile, wherein said at least one additional selected profile is defined by the additional selected spacing of said at least one additional plurality of grooves, wherein the selected spacing of said at least one additional selected profile is different from the selected spacing defining said first selected profile, and wherein the additional complementary profile is configured to lock only with said at least one additional selected profile.

6. The system of claim 1, wherein the first selected profile is disposed proximate to a joint within the tubular string, and wherein the tool is oriented to cut or perforate the tubular string at the joint or proximate to the joint when the first complementary profile is locked within the first selected profile.

7. The system of claim 1, further comprising a mounting member configured for attaching to an external surface of a tool, wherein the mounting member comprises a continuous band configured for fixable attachment to non-threaded surfaces of the tool.

8. The system of claim 1, wherein the first complementary profile is configured to lock only with the first selected profile.

9. The system of claim 1, wherein the tool is oriented to cut or perforate the tubular string, and wherein the tubular string comprises a drill pipe, a drill collar, a downhole tool, a tubular component, or combinations thereof.

10. A method for positioning a tool within a wellbore, the method comprising the steps of:

providing an interior of a tubular string with a first plurality of grooves, wherein the first plurality of grooves defines a first selected profile, wherein the first selected profile is defined by a first selected spacing of the first plurality of grooves;

providing the tool with a first blade comprising a first plurality of protruding members, wherein the first plurality of protruding members define a first complementary profile configured to lock within the first selected profile;

providing an additional blade interchangeable with the first blade, wherein the additional blade comprises an additional plurality of protruding members, wherein the additional plurality of protruding members define an additional complementary profile configured to lock only within an additional selected profile, wherein an additional selected spacing of said additional complimentary profile is different from the first selected spacing defining the first complimentary profile;

securing a collar directly to the external surface of a torch, a cutter, or a perforating device and attaching the first blade to the collar with a hinged arm, wherein the first blade and the collar each comprise a single point of connection with the hinged arm;

biasing the first blade in an outward direction to cause locking of the first complementary profile within the first selected profile; and lowering the tool and the first blade within the tubular string until the first complementary profile locks within the first selected profile, thereby positioning the tool proximate to the first plurality of grooves.

11. The method of claim 10, further comprising the step of:

providing the interior of the tubular string with at least one additional plurality of grooves defining at least one additional selected profile, wherein the at least one additional selected profile is defined by the selected spacing of said at least one additional plurality of grooves, and wherein the selected spacing of said at least one additional selected profile is different from the selected spacing defining said first selected profile;

providing the tool with the additional blade comprising a profile that is complementary to the at least one additional selected profile and configured to lock only within the at least one additional selected profile for enabling a positioning of the tool adjacent to the at least one additional selected profile;

biasing the additional blade in an outward direction to cause locking of the additional complementary profile within the additional selected profile; and lowering the tool and the additional blade within the tubular string until the additional complementary profile passes over the first selected profile and locks within the additional selected profile, thereby positioning the tool proximate to the additional plurality of grooves.

12. The method of claim 10, further comprising the step of providing a removable member disposed on and removable from the interior surface of the tubular string, wherein the removable member comprises the first selected profile of first plurality of grooves disposed thereon.

13. The method of claim 10, further comprising the step of shearing a shearable member to remove the first complementary profile from the first selected profile.

14. The method of claim 10, wherein the step of providing the interior of the tubular string with the first plurality of grooves comprises providing the tubular string with a sub comprising the first plurality of grooves disposed therein.

15. The method of claim 10, wherein the step of lowering the tool and the first blade within the tubular string comprises positioning the tool proximate to a joint within the tubular string, wherein the step of lowering the tool and the additional blade within the tubular string comprises positioning the tool proximate to an additional joint within the tubular string.

16. The method of claim 15, further comprising the step of actuating the tool to cut or perforate the tubular string proximate to the joint or the additional joint.

17. The method of claim 16, wherein the step of actuating the tool to cut or perforate the tubular string at or proximate to the joint comprises at least partially cutting or perforating a threaded portion of the tubular string to release torque from the joint to facilitate removal of a portion of the tubular string from the wellbore.

18. The method of claim 10, further comprising the step of actuating the torch, the cutter, or the perforating device to cut or perforate at least a portion of the tubular string, wherein the tubular string comprises a drill pipe, a drill collar, a downhole tool, a tubular component, or combinations thereof.

19. The method of claim 18, wherein the step of actuating the torch, the cutter, or the perforating device to cut or perforate said at least a portion of the tubular string further comprises removing said cut or perforated at least a portion of the tubular string from the wellbore.

20. A system for adapting a tool for achieving a selected position within a wellbore, the system comprising:

a mounting member configured for attaching directly to an external surface of a tool, wherein the mounting member comprises a collar configured for direct attachment to non-threaded external surfaces, wherein substantially all of the collar is positioned concentrically about the tool, and wherein the tool comprises a torch, a cutter, a perforating device, or combinations thereof;

a blade attached to the mounting member using a hinged arm, a pivotable arm, or combinations thereof, wherein the blade and the mounting member each comprise a single point of connection with the hinged arm, wherein the mounting member retains the hinged arm and the blade in relation to the tool, wherein the blade comprises a plurality of protruding members, and wherein the plurality of protruding members define a first selected profile configured to lock within a plurality of grooves defining a first complementary profile, and wherein the plurality of grooves are positioned within a wellbore; and a biasing member in communication with the blade, wherein the biasing member continually biases the blade away from the tool for engaging the plurality of protruding members with the plurality of grooves.

21. The system of claim 20, wherein the plurality of grooves is disposed within an interior of a tubular member disposed within the wellbore, and wherein the complementary profile is defined by a selected spacing of the plurality of grooves.

22. The system of claim 21, wherein the complementary profile is further defined by a depth of the plurality of grooves, an interior shape of the plurality of grooves, or combinations thereof.

23. The system of claim 20, further comprising a removable member disposed on and removable from the interior surface of the tubular string, and wherein the removable member comprises the first selected profile of the first plurality of grooves disposed thereon.

24. The system of claim 20, further comprising:

at least one additional plurality of grooves disposed within the interior of the tubular string, wherein the at least one additional plurality of grooves defines at least one additional selected profile, wherein the at least one additional selected profile is defined by the selected spacing of the at least one additional plurality of grooves, and wherein the selected spacing of the at least one additional selected profile is different from the selected spacing defining the first selected profile; and an additional blade, wherein the additional blade comprises an additional plurality of protruding members, wherein the additional plurality of protruding members define an additional complementary profile configured to lock only within the additional selected profile, wherein the selected spacing of the additional complimentary profile is the same as the selected spacing defining the at least one additional selected profile, and wherein the additional blade is configured to lock only within the at least one additional selected profile.

25. The system of claim 20, wherein the position of the mounting member is fixedly adjustable along the length of the tool.

26. The system of claim 21, wherein the tubular member comprises a drill pipe, a drill collar, a downhole tool, a tubular component, or combinations thereof.

* * * * *